US005224841A

United States Patent [19]

Thompson et al.

[11] Patent Number: 5,224,841

[45] Date of Patent: Jul. 6, 1993

[54] PNEUMATIC BELLOWS PUMP WITH SUPPORTED BELLOWS TUBE

[75] Inventors: Raymon E. Thompson, Lakeside; Karl Martin; Aleksander Owczarz, both of Kalispell, all of Mont.

[73] Assignee: Semitool, Inc., Kalispell, Mont.

[21] Appl. No.: 874,333

[22] Filed: Apr. 24, 1992

[51] Int. Cl.[5] ..... F04B 3/17

[52] U.S. Cl. ..... 417/392; 417/473; 92/37; 92/44

[58] Field of Search ..... 417/473, 474, 393, 392; 92/37, 42, 44

[56] References Cited

U.S. PATENT DOCUMENTS

| | | | |
|---|---|---|---|
| 3,847,511 | 11/1974 | Cole | 417/346 X |
| 4,543,044 | 9/1985 | Simmons | 417/346 X |
| 4,902,206 | 2/1990 | Nakazawa | 417/473 X |
| 4,983,104 | 1/1991 | Kingsford | 417/473 |
| 5,141,412 | 8/1992 | Meinz | 417/473 |

FOREIGN PATENT DOCUMENTS

| | | | |
|---|---|---|---|
| 591920 | 7/1957 | Italy | 417/472 |
| 956847 | 4/1964 | United Kingdom | 417/473 |
| 4106 | 4/1990 | World Int. Prop. O. | 417/473 |

*Primary Examiner*—Richard A. Bertsch
*Assistant Examiner*—Michael I. Kocharov
*Attorney, Agent, or Firm*—Wells, St. John, Roberts, Gregory & Matkin

[57] ABSTRACT

A low contamination double bellows pump suitable for providing relatively constant pressure and delivery. The illustrated pump includes two pumping chambers with bellows arranged in opposed relationship on opposite sides of a central section. The central section acts as a valve body for inlet and outlet valves. The bellows are provided with interior bellows tubes which connect to the free ends of the bellows and slide upon stationary support pistons mounted within each tube. Bellows tube head pieces slide upon piston rods which support the pistons. Pneumatic pressure is controllably supplied to opposing sides of the pistons within the bellows tubes to power the bellows and effect pumping.

32 Claims, 7 Drawing Sheets

FIG. II

PNEUMATIC BELLOWS PUMP WITH SUPPORTED BELLOWS TUBE

TECHNICAL FIELD

The technical field of this invention is low contamination pneumatically driven bellows pumps, particularly those used in processing equipment for producing semiconductors, compact disks, photomasks, flat panel displays and other products subjected to liquid processing, especially involving corrosive chemicals.

BACKGROUND OF THE INVENTION

The processing of semiconductor wafers, substrates, photomasks, flat panel displays, compact disks and similar articles typically involves the use of highly purified processing chemicals. The high purity of the processing chemicals is necessary to prevent contamination of the product by particles which can cause defects in the finished goods. Frequently the processing chemicals are corrosive, caustic or otherwise difficult to handle.

Prior chemical delivery pumps used in low contamination systems typically have suffered from several limitations. Positive displacement pumps have often been used to allow better control over the amount of chemicals delivered. However, most positive displacement pumps provide flow rates which normally vary with time during the pumping process. Typically, positive displacement chemical delivery pumps have a pulsating outflow. Pulsating outflows develop undesired force fluctuations in associated tubing, piping, and other equipment parts and can cause fluid hammering. Hammering can be destructive to the fluid conduits and associated valving. It can also cause more general mechanical problems due to the associated vibration. Fluid hammering and vibrations also cause the generation of particles in and around the semiconductor processing machines. The generated particles cause contamination problems which are difficult to adequately rectify using filtration systems or other approaches.

Prior centrifugal and positive displacement chemical delivery pumps have also suffered problems when confronted with mixed liquid and gaseous phases in the flow stream. In some cases, such as centrifugal pumps, a mixed phase flow can cause loss of liquid in the pumping cavity. This can cause the pump to stop pumping. In positive displacement pumps the passage of mixed phase flows can result in detrimental effects on the pump and system operation. These detrimental effects are sometimes due to fluctuations in the loading experienced by the pump and associated forces, vibration and particle generation.

The current invention provides a novel bellows pump which provides an even delivery flow rate and even pressure output. It also minimizes pulsation and vibration related problems, especially particle generation. These and other benefits and advantages of the invention are set forth herein or apparent from the information given herein.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
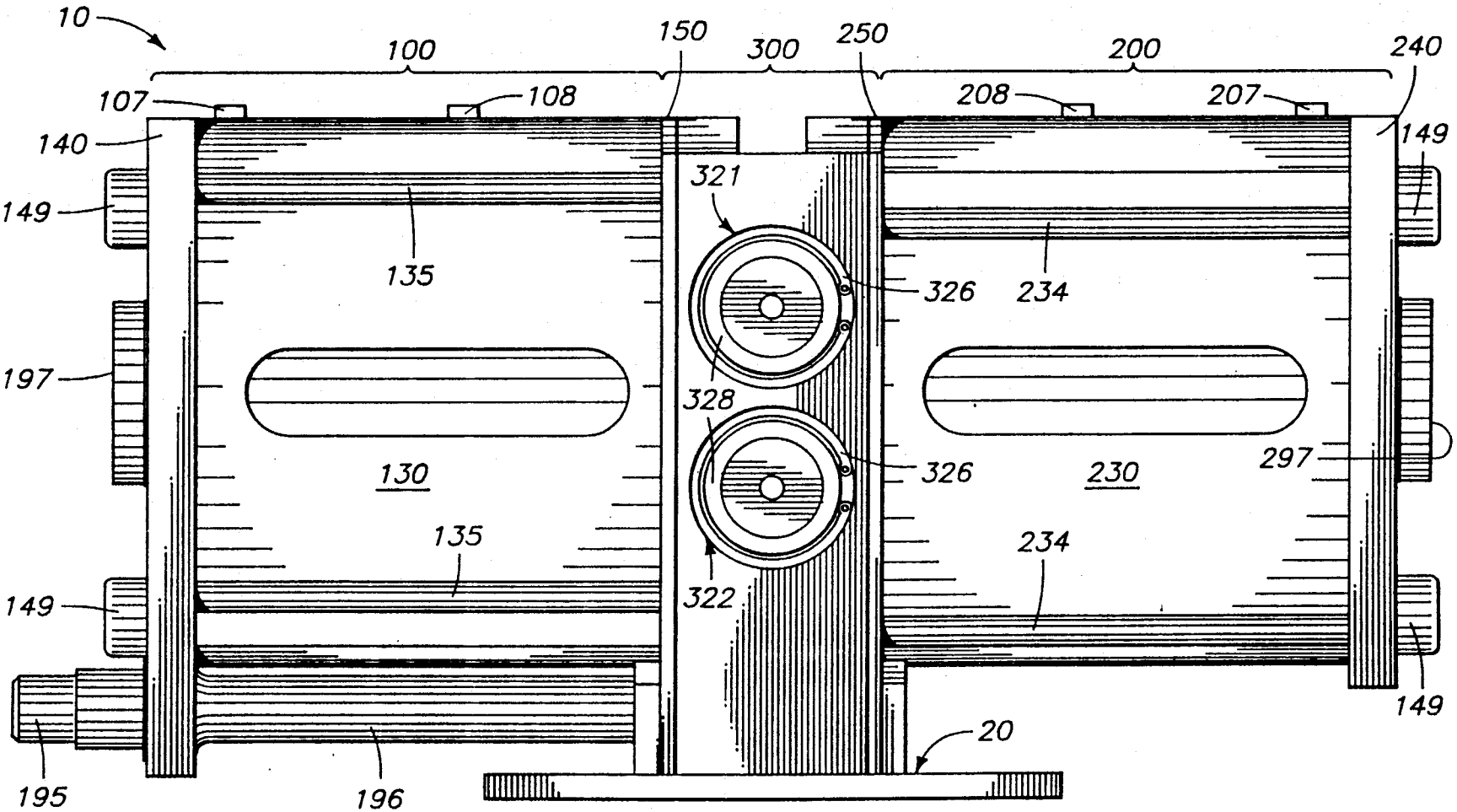
FIG. 1 is a side elevational view of a pump according to this invention.

FIG. 1 shows a preferred pump 10 according to this invention. Pump 10 has a base 20 which acts as a frame and is mounted to a supporting structure or framework (not illustrated) of a processor in which the pump is mounted. Pump 10 includes a first section generally referred to by the reference numeral 100 and a second section generally referred to by the reference numeral 200. First and second sections 100 and 200 are similar. The first and second sections 100 and 200 are connected to a central section 300 which structurally supports the first and second sections. Central section 300 is connected to the base assembly 20. Description will be made in connection with structural components of section 100. Similar features used in sections 100 and 200 are numbered with reference numbers which are the same in the tens and units columns with a leading (1) or (2) in the hundreds column for the parts in sections 100 or 200, respectively.

Figure 3:
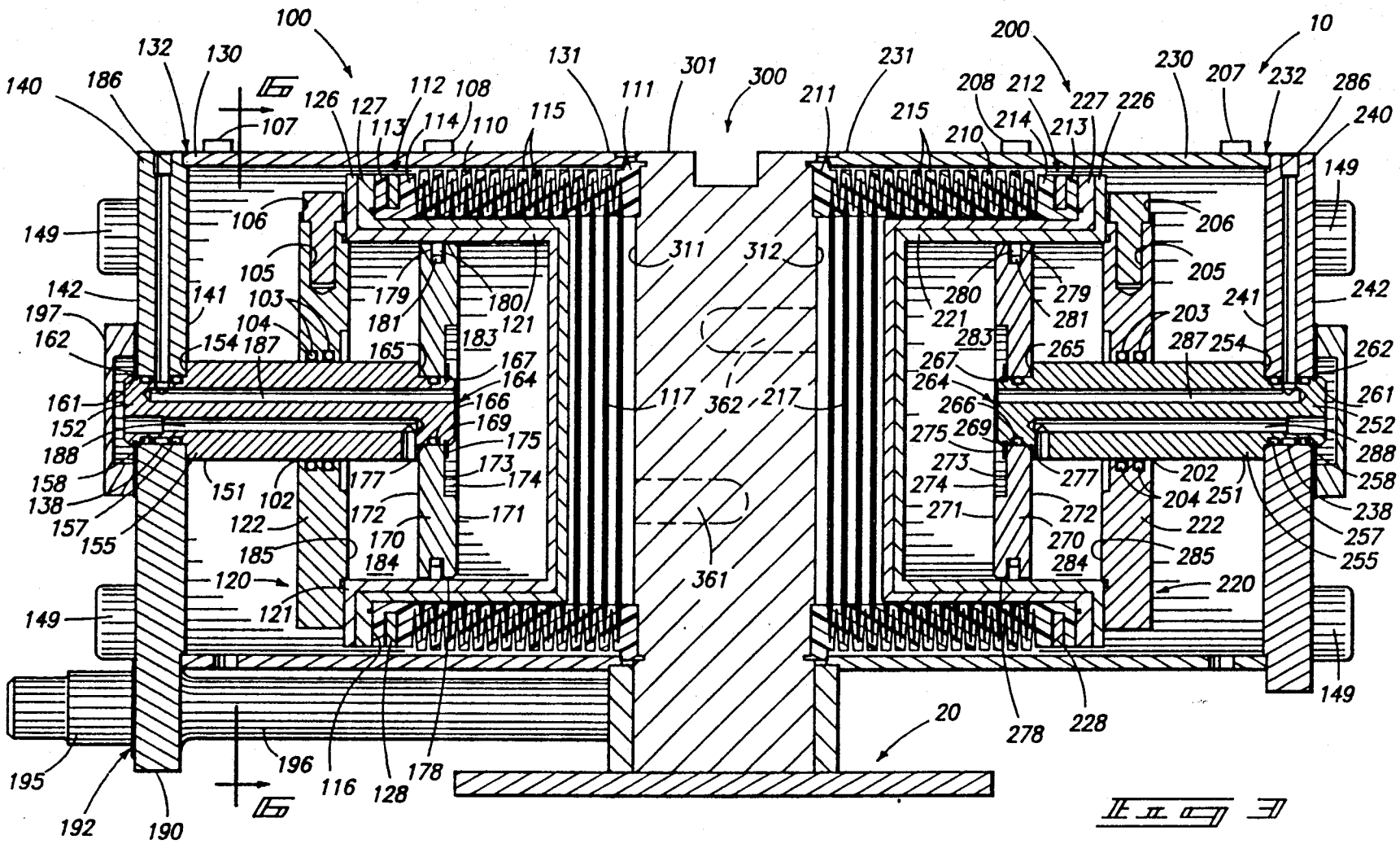
FIG. 3 is a sectional view taken along a vertical longitudinal plane illustrated by section line 3—3 of FIG. 2.

FIG. 3 illustrates various internal components making up the first and second sections of pump 10. First section 100 includes a first bellows 110 which is mounted between the central section body piece 301 and a bellows head assembly 120. Bellows 110 includes a proximate end flange 111 and a distal end flange assembly 112. The distal end flange assembly includes an outer or first flange ring 113 and an inward or second flange ring 114. Bellows 110 additionally includes a series of similar convolutions 115 which extend between the proximate flange 111 and distal flange assembly 112. The convulsions form a flexible sidewall of the bellows. This flexibility allows the bellows to expand and contract in a longitudinal or axial direction in response to controlled pneumatic pressure as will be described more fully hereinafter.

Bellows 110 is surrounded by an external bellows cover 130. Bellows cover 130 is a cylindrical tubular member which has a proximate end 131 and distal end 132. The proximate end 131 of bellows cover 130 bears against the outer portions of proximate flange 111 and holds the proximate end of bellows 110 in position against the first end face of central piece 301. The distal end of bellows cover 132 is held in proper position and forced inwardly to a desired degree by an end plate 140.

FIG. 1 shows that end plate 140 is held and positioned using four mounting rods 135. The mounting rods are threaded at their proximate ends into apertures 234 formed in the second face plate 250. Second face plate 250 is positioned adjacent to the second face 312 of central body piece 301. The mounting rods 135 extend from apertures 234 in second face plate 250 through apertures 335 formed through body piece 300. Mounting rods 135 further extend through apertures 136 formed in the first face plate 150. The distal ends of mounting rods 135 are positioned through apertures 143 formed through end plate 140. The distal ends of mounting rods 135 are threaded to receive end plate retaining nuts 145 which transfer forces to end plate 140. The mounting rods force the end plate against the bellows cover 130.

Figure 7:
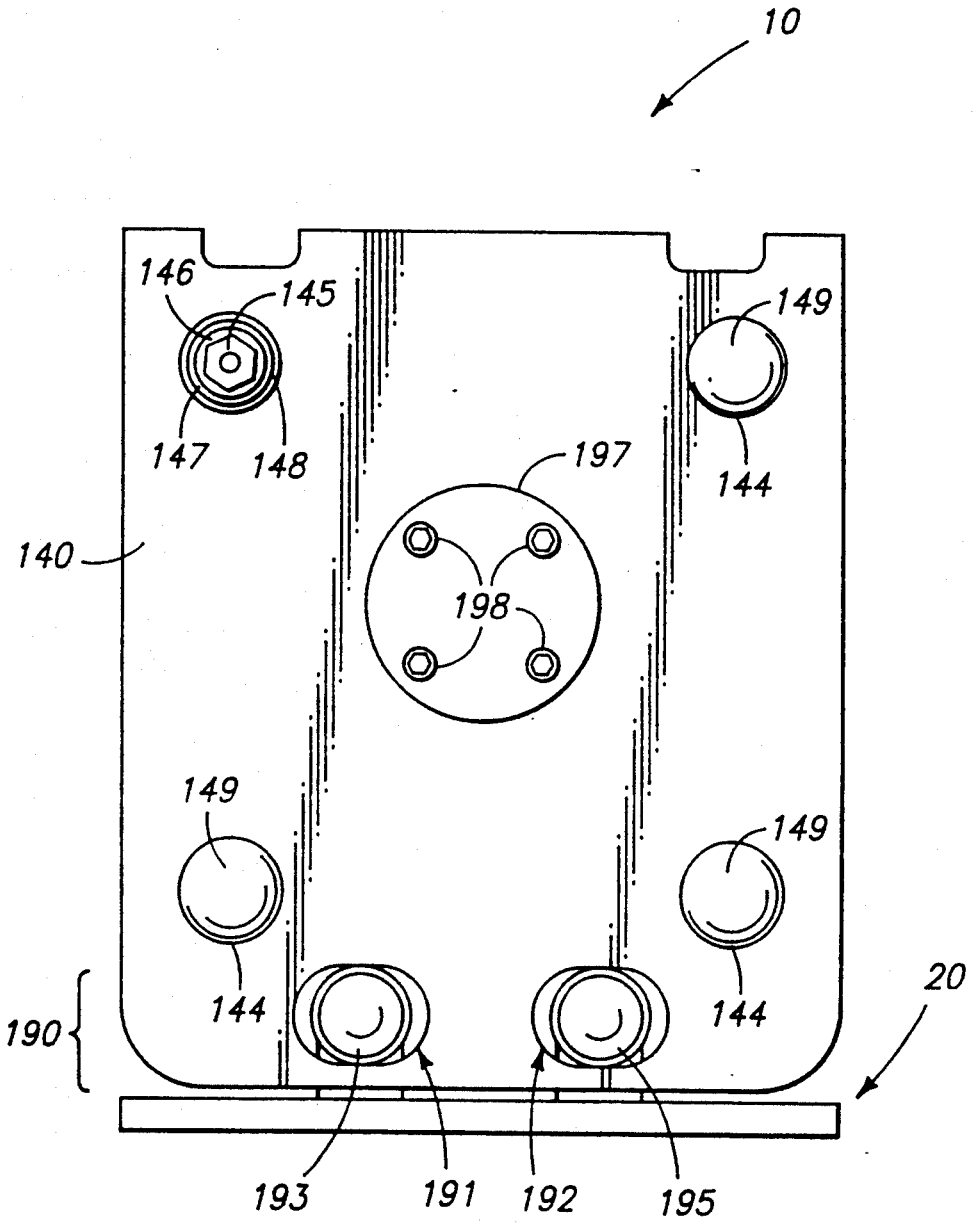
FIG. 7 is a left end view of the pump of FIG. 1.

FIG. 7 shows that the end plate retaining nuts are preferably received within enlarged recesses 144 formed adjacent to apertures 143. The enlarged recesses 144 are advantageously covered using mounting bolt covers 149 which exclude foreign materials. Also preferably included at each connection between the mounting rods 135 and end plate retaining nuts 145 are a series of suitable mounting washers. The preferred construction uses a first end plate mounting washer 146 which is preferably a flat stainless steel washer. Next is a second end plate mounting washer 147 which is preferably a bellville washer. Also preferably included is a third end plate mounting washer 148 which is preferably a flat stainless steel washer. The mounting nuts 145 are then used to secure the end plate and mounting washer assembly against the mounting rods. The forces developed by tightening nuts 145 force the inner face 141 of end plate 140 against the external bellows cover 130. The bellows cover 130 also contacts the outer face of first face plate 150 and the outer portions of proximate flange 111.

FIG. 3 shows that the free or distal end of the bellows slides upon a bellows tube support assembly which is cantilevered inwardly from end plate 140. End plate 140 directly mounts a piston rod 151. Piston rod 151 is preferably provided with a distal end extension 152 which is of reduced diametrical size and fits into a piston rod mounting aperture 138. A shoulder 154 is formed at the transition between the intermediate section 155 and the distal end extension section 152 of piston rod 151. Shoulder 154 bears against the inner face 141 of end plate 140. The distal end section 152 preferably accommodates a suitable piston rod distal end seal. As shown, the piston rod distal end seal is advantageously formed using a pair of spaced ring seals 157 and 158. Ring seals 157 and 158 are preferably Viton TM O-rings received within appropriately sized grooves formed in the distal end section 152 of the piston rod.

The distal end section 152 forms a suitable piston rod mount. As shown the piston rod mounting includes a means for retaining the piston rod to the end plate 140. This is preferably accomplished using a mounting ring groove 161 formed in the piston rod adjacent the outer face of end plate 140. Groove 161 receives a snap ring or other suitable retainer 162 which bears against the outer face 142 of end plate 140.

Piston rod 151 also includes a proximate end extension or section 164. Proximate end extension 164 is of reduced diametrical size relative to the intermediate section 155 of piston rod 151. A shoulder 165 is formed between the reduced diametrical size of proximate section 164 and intermediate section 155. Shoulder 165 bears against the outer face 172 of piston 170. The inner face 171 of piston 170 is provided with a central recess 173 which receives the end portions of proximate end section 164. Central recess 173 has a bottom surface 174.

Piston 170 is retained on the proximate end of piston shaft 170 using a suitable piston retainer or mounting structure. As shown, the piston retainer includes a groove 167 which is formed near the extreme end of proximate end section 164. The circumferential groove 167 receives a snap ring or other suitable retainer 175.

The proximate end extension 164 is also advantageously provided with a seal for sealing between the mounting aperture 177 formed in the piston and the proximate end extension 164 of piston rod 151. As shown, the seal is preferably formed using a seal groove 166 which is formed circumferentially about the proximate end extension. Groove 166 receives an O-ring or other suitable ring seal 169.

The outer circumferential face or edge 178 of piston 170 is also preferably provided with a suitable outer piston sealing means. As shown, the outer piston sealing means is formed by a piston ring 180 which bears against the inner wall of the surrounding cylinder piece 121. Piston ring 180 is mounted in an outer edge groove 179 formed about the outer edge 178 of piston 170. A resilient piston ring biasing member 181 fits within groove 179 within the inside of piston ring 180 to resiliently bias the piston ring against the inside surfaces of piston cylinder 121.

Figure 6:
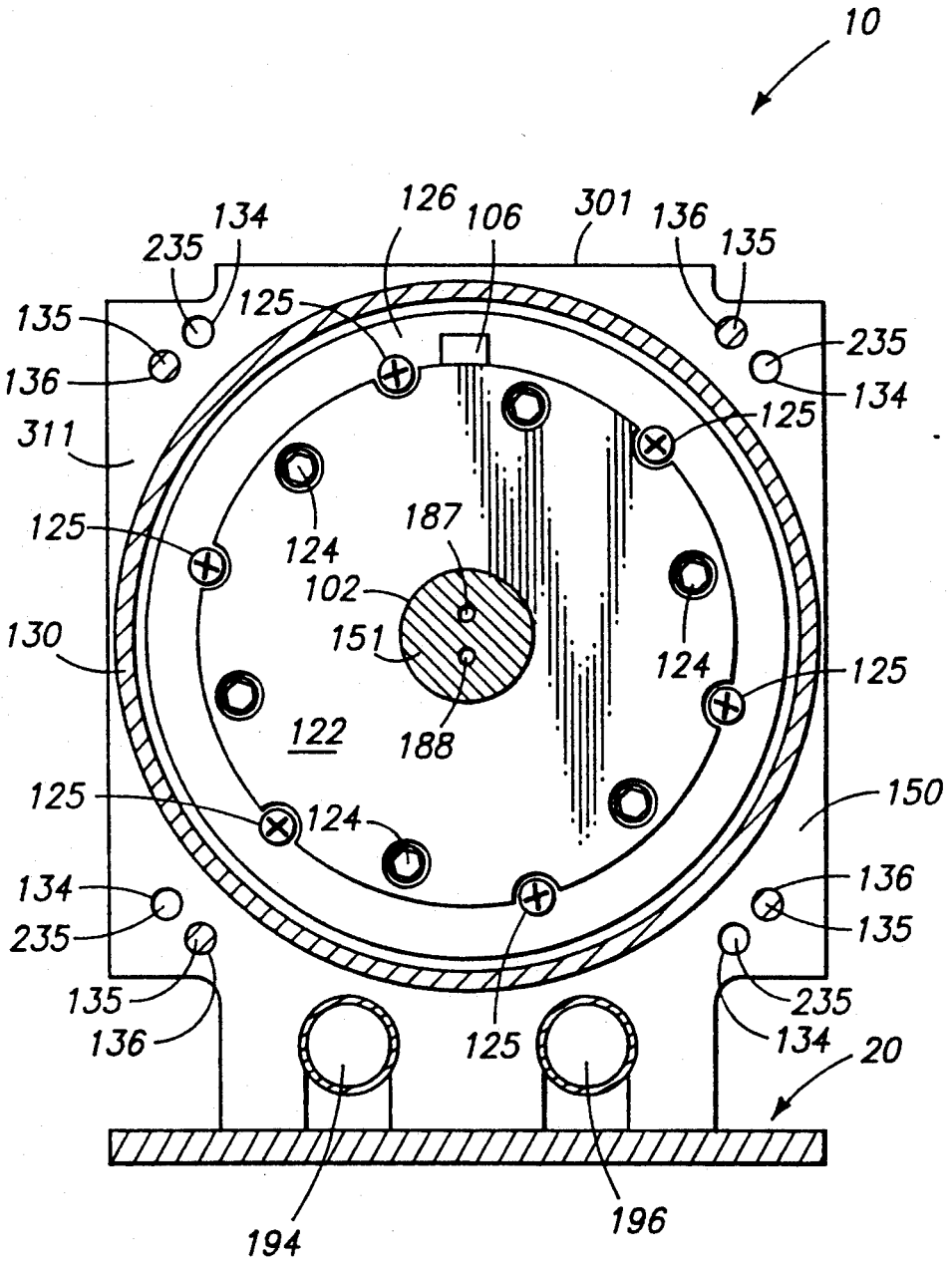
FIG. 6 is a sectional view taken along a vertical transverse plane illustrated by section line 6—6 of FIG. 3.

The bellows head assembly 120 is slidably mounted for guided translational motion upon the stationary bellows tube support assembly formed by piston 170 and associated piston rod 151. The bellows head assembly 120 includes a cylinder head piece 122 and a piston tube or cylinder 121. The bellows head assembly also most preferably includes a piston tube or cylinder sleeve 123 which fits over the piston cylinder adjacent the first pumping chamber 117 and interior edges of the bellows convolutions. A plurality of bellows head assembly fasteners 124 (see FIG. 6) extend through apertures formed through the cylinder head 122. These apertures align with corresponding apertures formed through the flange 126 of cylinder 121. Additional apertures which receive fasteners 125 extend through flanges 126 and 127 and the outer flange ring 113 formed at the distal end flange assembly of bellows 110. A pair of semicircular retainer plates 128 fit within groove 116 formed between outer and inner flanges 113 and 114 at the distal end of the bellows. Fasteners 125 extend through the series of apertures and are threadably received within threaded apertures formed in the retainer plates 128.

Cylinder head piece 122 is slidably mounted upon the intermediate section 155 of piston rod 151. This is advantageously accomplished by providing a cylinder head central bore 102 of slightly larger diametrical size than the intermediate section 155 of the piston rod. The inner wall of bore 102 is preferably provided with means for sealing between the cylinder head and the piston rod to allow pressurization of chamber 184. This is advantageously accomplished using a pair of cylinder head central bore sealing grooves 103 formed along the inner wall of bore 102. Sealing grooves 103 advantageously receive corresponding ring seals 104 which are most preferably O-ring type seals.

Cylinder head piece 122 is also preferably provided with a sensor magnet mounting aperture 105. Aperture 105 receives a magnet 106. As shown, aperture 105 is positioned along the upper peripheral edge of the cylinder head piece 122 to allow detection by sensors 107 and 108. The magnet is detected by the expansion position sensor 107 when the first bellows is in an expanded condition. The magnet is detected by the contraction position sensor 108 when the first bellows is in a contracted condition.

FIG. 3 illustrates that the bellows head assembly 120 functions as a bellows operator in conjunction with the bellows tube support. The bellows head assembly is powered between extended and retracted positions using pressurized gas supplied to the inward and outward chambers 183 and 184. The first, inward or contractionary pressure chamber 183 causes contraction of the bellows and is defined between the inward face 171 of piston 170 and the inside of cylinder piece 121. The second, outward or expansionary chamber 184 causes expansion of the bellows and is defined between the outward face 172 of piston 170 and the inward face 185 of the cylinder head piece 122. Chamber 184 is also defined along the outer periphery by the cylindrical or other shaped bore of cylinder or tube piece 121.

The contractionary chamber 183 is supplied pressurized gas to compress bellows 110 and contract pumping chamber 117. Pressurized gas such as air or nitrogen is advantageously supplied to the contractionary chamber through a contractionary chamber supply port 186 formed in the upper edge surface of end plate 140. Supply port 186 has an associated conduit which extends downwardly through end plate 140 and connects with a conduit 187 formed in the piston rod 151.

Pressurized gas is supplied to expand bellows 110 and expand pumping chamber 117 through port 189. Port 189 has an associated downwardly extending conduit that runs through end plate 140 and opens into a passage formed under end cap 197. End cap 197 is held in position by end cap socket head cap screws 198 (see FIG. 7). The passage inside end cap 197 passes gas into the longitudinal conduit 188 formed through the piston rod. Conduit 188 extends transversely near the piston to communicate gas into and from expansionary chamber 184.

The second pump section 200 is constructed substantially the same as the components described hereinabove with regard to first section 100. Parts similar to those described above in connection with section 100 are numbered for section 200 using similar numbers with a 2 instead of a 1 in the hundreds column. Description of such second pumping head parts will not be repeated for the sake of brevity.

The first pump section 100 differs from second pump section 100 with regard to the downward extension 190 of end plate 140. Downward extension 190 supports the inflow and outflow conduits 194 and 196, and associated inflow and outflow connection fittings 193 and 195, respectively. FIG. 7 shows that downward extension 190 is provided with apertures 191 and 192. Aperture 192 receives the inflow connection fitting 195 and attached inflow conduit 196. Aperture 191 receives an outflow connection fitting 193 and attached outflow conduit 194. Fluids flowing to pump 10 are supplied through fitting 195 and conduit 196 to the inflow gallery or chamber 320 within central section 300. Fluids flowing from the pump move from the outflow gallery or chamber 340 of central section 300 out through outflow conduit 194 and outflow fitting 193. Conduits 194 and 196 connect through ports formed in the first face 311 of the central body piece 301.

Figure 4:
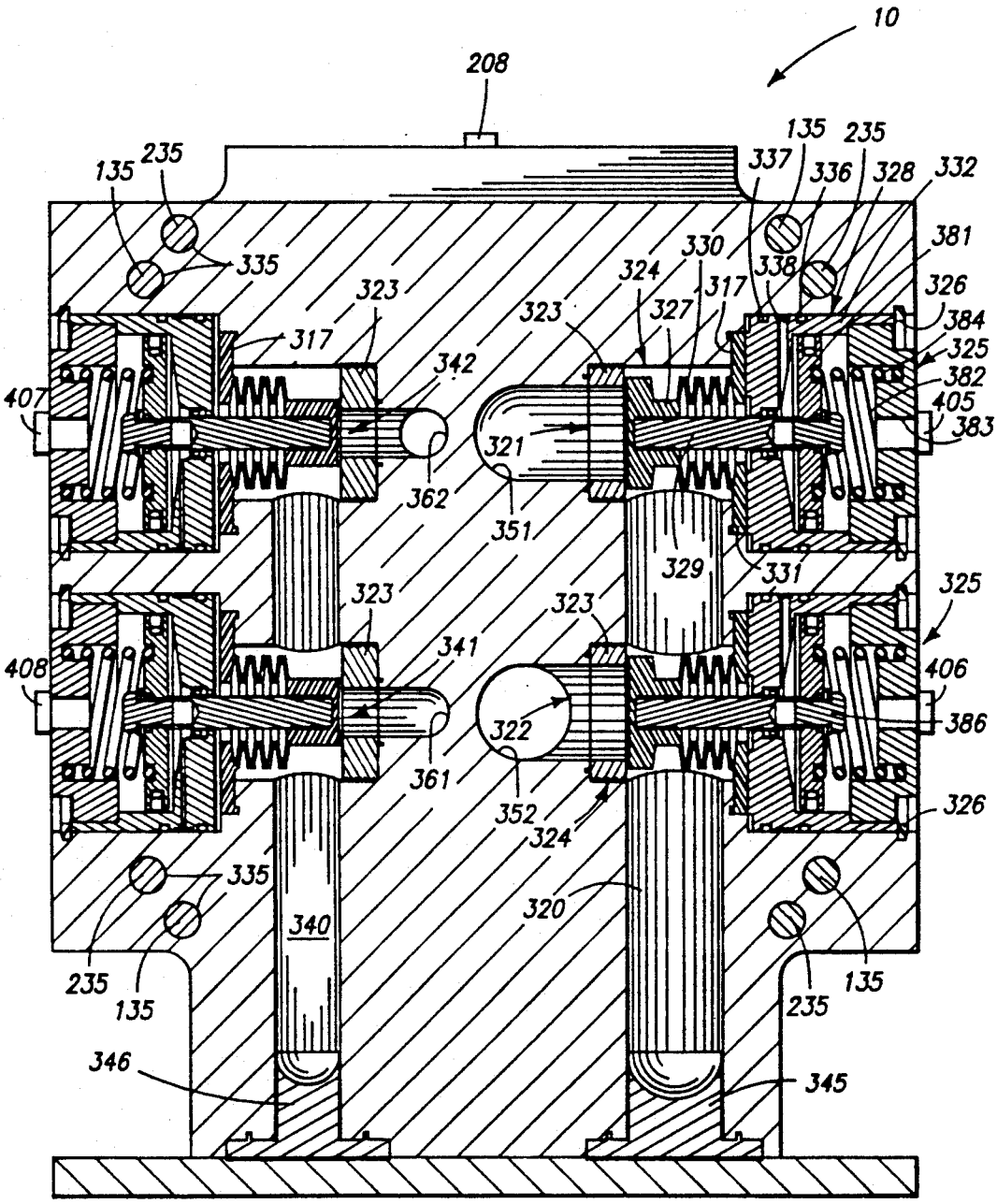
FIG. 4 is a sectional view taken along a vertical transverse plane illustrated by section line 4—4 of FIG. 2.

The central section 300 serves as a valve body piece for mounting first and second inlet and outlet valves. FIG. 4 shows first and second inlet valves 321 and 322. Also shown are first and second outlet valves 341 and 342. First inlet valve 321 controls the flow of incoming fluid from inlet gallery 320 to the first bellows interior or pumping chamber 117 via first inlet valve passageway 351. The flow of fluid from first pumping chamber 117 passes through the first outlet valve passageway 361 and to the outflow gallery as controlled by the first outlet control valve 341. Fluid forced from first bellows pumping chamber 117 flows through passageway 361, valve 341 to the outlet or outflow chamber 340. Fluid flows from outflow chamber 340 to outflow conduit 196 and outflow fitting 195.

Incoming fluid is also supplied from inlet gallery 320 to the second bellows pumping chamber 217 as controlled by the second inlet valve 322 and communicated via second inlet valve passageway 352. Fluid forced from second bellows pumping chamber 217 flows via second outlet valve passageway 362 and is controlled by second outlet valve 342. Fluid flowing through valve 342 passes into the outflow chamber 340 and associated outflow conduit fittings 196 and 195, respectively.

FIG. 4 shows the specific construction of the inlet and outlet valves 321, 322 and 341, 342 in detail. Inlet valve 321 is similar to inlet valve 322 and similar reference numerals will be used to refer to the similar parts. Outlet valves 341 and 342 are similar to each other and also share substantial similarity with the inlet valves 321 and 322. The outlet valves are smaller is size to restrict the discharge rate and allow faster charging of the pumping chambers than discharging. The inlet valves are also larger in size to enable them to work as automatic pressure relief valves due to their larger area exposed to the pressure developed by each bellows. The inlet valves relieve pressure by passing fluid from the pumping chambers into the inlet gallery 320. Description will now be made with respect to the first inlet valve. Common parts exist in all four valves and description thereof will not be repeated for the sake of conciseness.

Each valve includes a valve seat 323 which is grooved and press fit into the associated valve cavity 324 formed in the central piece 301. Central piece 301 serves as the valve body piece. Each valve cavity also mounts removable valve assemblies 325 with associated valve operators 328. The removable valve and operator assemblies are held in mounted position by a suitable valve assembly retainer such as valve assembly mounting retainer 326, advantageously in the form of a snap ring.

The valve assemblies 325 each include a removable valve head 327 which is of a poppet type and extended or retracted by an associated operator 328. The valve head 327 is extended into sealing contact against valve seat 323 or retracted outwardly therefrom to open the valve. Valve head 327 is connected to the valve operator 328 using a valve stem 329. Valve head 327 has a flexible valve bellows 330 which protects the valve stem from the corrosive fluids which may be passed by the valves. Valve bellows 330 extends between the movable portions of valve head 327 and mounting flange 331 of the valve head assembly. Mounting flange 331 seals against a valve cavity mounting face 317.

Figure 2:
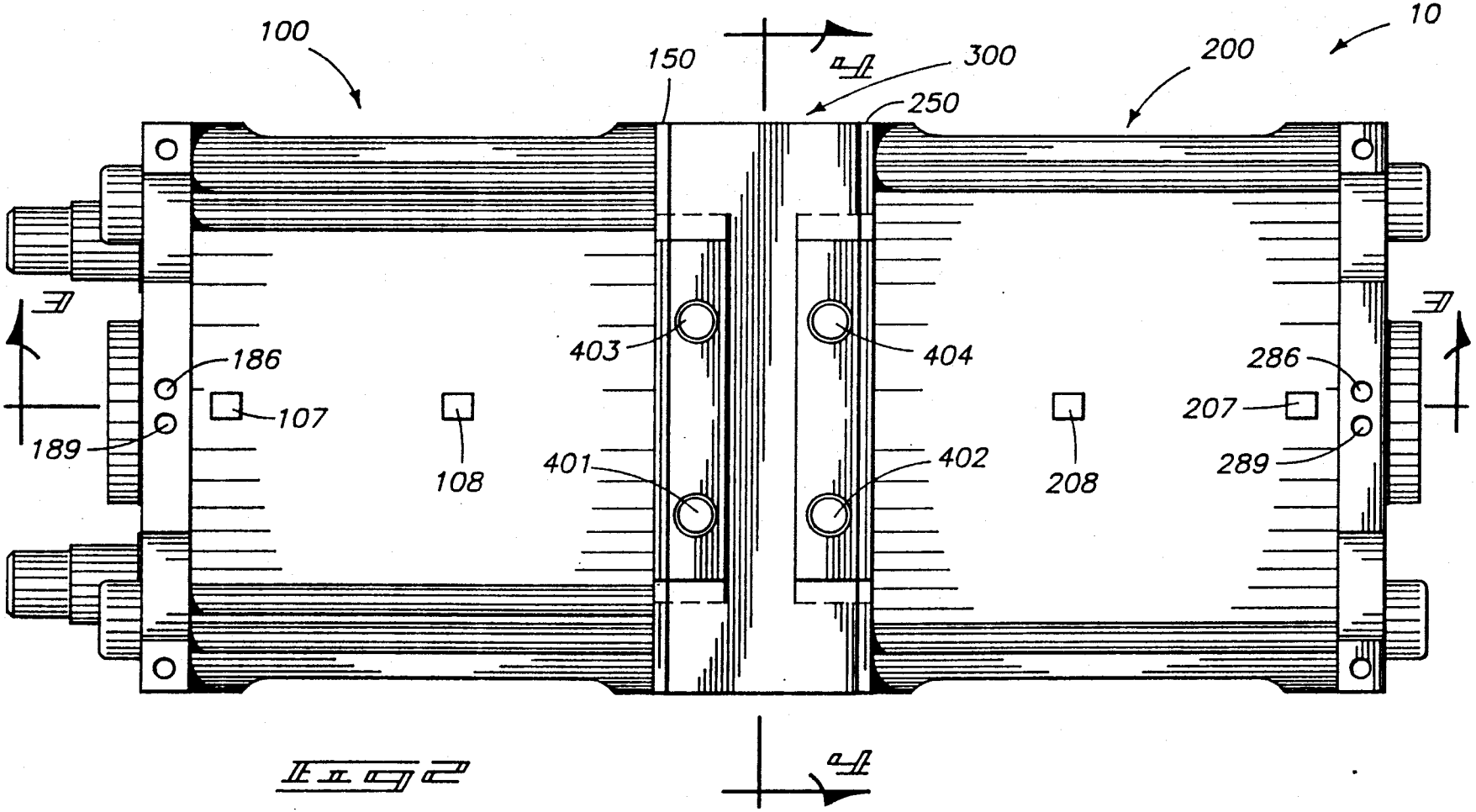
FIG. 2 is a top view of the pump of FIG. 1.

The valve operators 328 each include an operator body piece 332. Operator body piece 332 is held in position by retainer ring 326. Proper positioning of the operator body piece by retainer ring 326 forces the inward face of the operator body piece against the flange 331 of the valve piece. This seals the flange against face 317. The circumference of operator body piece 332 is preferably provided with seals 336 and 337. Seals 336 and 337 enclose an annular chamber which supplies pressurized actuating gas to the operator. FIG. 2 shows actuating gas supply passages 401–404 which supply gas to the annular chambers between seals 336 and 337 for the first and second inlet valves, and first and second outlet valves respectively. Gas fed to the annular chambers passes into the operators through conduits 338 formed in the operator body piece 332. Gas entering through conduit 338 forces an operator piston 381 outwardly. The outward motion of piston 381 is transferred to the valve stem 329. The valve operator piston 381 is connected to the valve stem 329 using a fastener 386. Pressure applied to the inward side of piston 381 unseats valve head 327 from valve seat 323. The valve operator piston 381 is biased inwardly toward closure by a biasing spring 384. The pistons can also be closed by applying pressure to the outside of operator pistons 381 within valve operator closing chamber 382 via port 383.

FIG. 4 also shows plugs 345 and 346 in the bottom of the inlet and outlet chambers 320 and 340. Plugs 345 and 346 allow maintenance access and close the bottom openings which are created when forming chambers 320 and 340.

Figure 5:
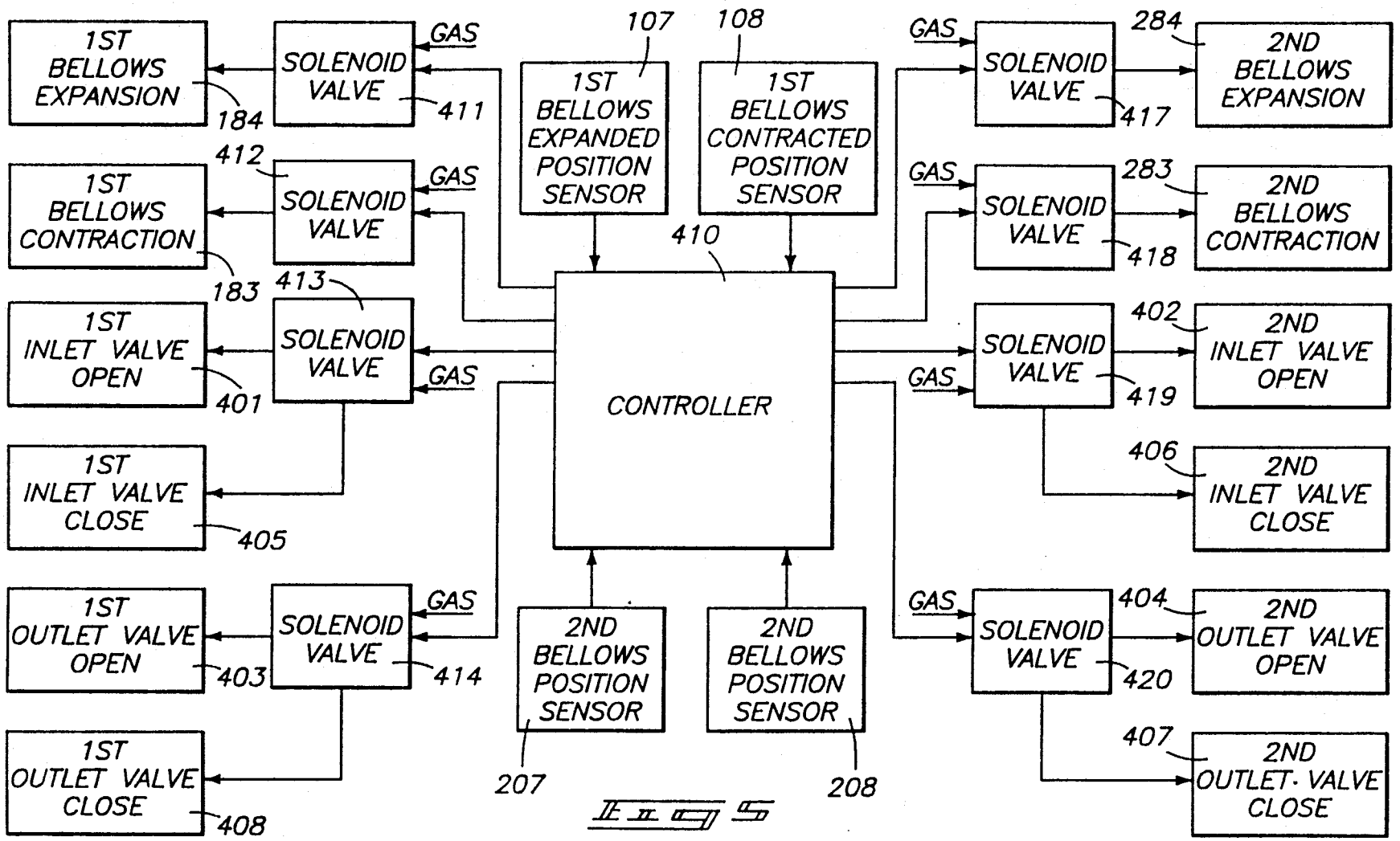
FIG. 5 is a schematic block diagram of the control system used to control the pump of FIG. 1.

FIG. 5 shows a schematic diagram of the preferred control system used to operate pump 10 of this invention. A central controller 410 is any suitable electronic controller, such as a microprocessor based controller, well known in the art. Controller 410 receives inputs from the first and second bellows position sensors 107, 108, 207 and 208. The controller also controls electrically operated solenoid gas control valves 411–414 and 417–420. Suitable control gas pressure or vacuum is supplied to these solenoid operated valves. As shown and described herein the control gas is preferably pressurized and will be herein described as pressurized with the understanding that vacuum pressures could also be used with suitable modifications. The pressurized gas is controlled to a pressure in the range of 20–50 psig. Activation of the electrically operated solenoid valves causes the pressurized control gas to flow to pressure chambers or pneumatic operators to operate, open or close as described more specifically hereinafter.

Solenoid valve 411 controls the flow of pressurized gas to the first bellows expansion chamber 184. Solenoid operated valve 412 controls the flow of control gas to the first bellows contractionary chamber 183. Flow of gas to the first inlet valve open operator 401 is controlled by solenoid valve 413. Solenoid valve 413 also can be used to control the flow of pressurized gas to the first inlet valve close side of the pneumatic operator at port 405, if desired. When connected in this manner valve 413 is a four-way valve having alternative pressurized fluid outputs which operate ports 401 and 405 in complementary relationship. Solenoid 414 also preferably controls the first outlet valve open gas supply 403 and first outlet valve close supply 408, also in complementary relationship.

Solenoid valve 417 controls the flow of pressurized gas to the second bellows expansion chamber 284. Solenoid valve 418 controls the flow of gas to the second bellows contractionary chamber 283. Solenoid valve 419 controls the flow of pressurized gas to the complementary second inlet valve operator open gas supply 402 or second inlet valve operator close gas supply 406. Solenoid valve 420 controls the flow of pressurized gas to the second outlet valve operator open gas supply 404 and complementary second outlet valve operator close gas supply 407.

Operations and Methods

The invention also includes novel methods which will be primarily described with respect to the preferred operation of pump 10 as shown and described herein. Pump 10 is preferably controlled upon startup to perform a desired set of steps which can advantageously be termed an initializing procedure. The initializing procedure can be structured in more than one manner and the initializing procedure set out herein has been arbitrarily selected to start with expansion of the first bellows 110, and contraction of the second bellows 210.

The initializing and other methods described herein are controlled using the central controller 410. The initializing or startup procedure begins with a set of instructions which are advantageous begun simultaneously upon startup of the pump and controller 410.

Upon startup the controller 410 communicates a first bellows expansion activation signal to solenoid valve 411. The first bellows driver is thus pressurized to cause bellows expansion when solenoid 411 supplies gas to chamber 184. Also upon startup the controller sends a second bellows contraction signal to solenoid 418. The second bellows driver is thus pressurized to cause bellows contraction when gas from solenoid 418 is supplied to chamber 283.

Pressurized gas supplied to chamber 184 leads to longitudinal sliding action of the first bellows head assembly upon the piston and piston rod. This sliding action is in the expansionary or outward direction. During the expansion of the first bellows, the first bellows contraction chamber 183 is preferably venting. The venting is best accomplished by using a solenoid valve 412 which automatically vents when it is inactive.

The expansion of first bellows 110 and associated first pumping chamber 117 is also accompanied by opening the first intake valve 321 and closing the first outflow valve 341. The first intake valve is opened by sending an active signal from controller 410 to solenoid valve 413. Gas is thus supplied to port 401. Gas supply 401 communicates pressurized control gas to passage 338 of the first inlet valve operator thereby retracting the valve head and opening the valve. Solenoid control valve 413 also functions by venting the first inlet valve close supply 405. Alternatively, the first inlet valve close port 405 can be left uncontrolled and open and the closing action can be accomplished solely by the biasing action of spring 384. The fluid being pumped can accordingly flow from the inlet chamber into the first pumping chamber 117.

The preferred initializing procedure also includes closing the first outlet valve 341 to prevent fluids from flowing from the first pumping chamber 117 to the outlet or outflow chamber 340. The closing of first outlet valve 341 can be accomplished by merely deactivating the first outlet valve signal and allowing the valve operator biasing spring 384 to close valve 341. Alternatively and more preferably, the first outlet valve can be actively pressurized for closure. This is preferably done by passing pressurized control gas through the second output of valve 414 to the first outlet valve close supply 408. Gas supplied to port 408 pressurizes against the valve operator piston 381 for first outlet valve 341 thus closing that valve. The complementary port 403 is vented by solenoid valve 414.

Also upon startup the second bellows is advantageously placed in a contracting mode of operation. This is controlled with controller 410 by producing a second bellows contraction activation signal. The second bellows contraction activation signal is communicated to solenoid control valve 418 thus activating that valve into an active state wherein the valve communicates pressurized control gas to the second bellows contraction chamber 284 via contraction conduits 288. The controller also deactivates solenoid 417. The deactivated solenoid valve 417 allows venting of the expansion chamber 284.

Further upon startup, controller 410 causes opening of the second outlet valve 342 and closing of the second inlet valve 322. The second outlet valve 342 is opened in a manner analogous to the opening of valve 321 described hereinabove using a second outlet valve activation signal which is communicated to solenoid control valve 420. Pressurized gas flows to the second outlet valve open supply 404 to cause opening of valve 342 using the associated valve operator. The fluid being pumped can accordingly flow from the second pumping chamber 217 to the outflow gallery 340.

The second inlet valve 322 is closed by deactivating the second inlet valve control signal sent from controller 410 to solenoid 419. This allows the biasing action of the spring 384 to close the valve. Additionally, pressurized control gas can also be supplied from solenoid valve 419 to port 406 to actively close the second inlet valve 322. Closure of the second inlet valve prevents backflow from the contracting pump chamber into the inlet gallery 320. The initializing procedure places the pump in a pumping mode of operation with the second pumping chamber being contracted. The amount of time required to expel fluids from the pumping chambers 117 or 217 is greater than the time required to expand the opposite pumping chamber which is being expanded. This is the case because the inlet valves and associate intake chamber are larger conduits which allow for faster charging or priming of the expanding chamber than for discharging. This provision allows the pump to have the charging pump chamber filled and ready to expel fluid as the discharging pump chamber finishes. The transition from the initial operating conditions wherein the first pumping chamber is being charged to a discharging mode of operation will now be described.

As the first pumping chamber is nearing the fully expanded or charged state, the first bellows head is expanded outwardly and the magnet 106 is detected by outer sensor 107. The detecting of the first bellows expansion condition is done in advance of full expansion so that the control gas pressure applied to the expansion chamber 184 can be relieved in advance of the fully expanded position. The inertia of the system causes the first bellows head to coast to the fully expanded or a near-fully expanded position. The coasting is helpful in reducing fluid pulsations in the outflow and general vibration of the pump. The expanded first bellows and associated first pumping chamber are awaiting completion of the contractionary pumping stroke which is being performed by the second bellows and associated second pumping chamber.

The controller 410 preferably is programmed to perform several timing functions based upon detection of magnet 106 by sensor 107, in order to perform proper timing of the transition from the charging to discharging modes of operation. The timing functions also provide for coordinated discharge so that fluid is nearly continuously pumped. The first, second and third timing functions are initiated when the expanding bellows is nearing expansion, such as by detecting magnet 106 using sensor 107.

The first or bellows drive pressure timing function is used to control the gas pressure within the expansion chamber 184. When the first bellows is nearly expanded, pressure is released by deactivating solenoid valve 411 and releasing the pressure applied to expansion chamber 184. A suitable bellows drive pressure timing period is in the range of 0–100 milliseconds after sensor 107 detects the magnet. It is not necessary in the embodiment shown to having any timing delay between detection by sensor 107 and terminating pressure supply to chamber 184. Any delay associated with the first timing period depends upon the position of the sensor relative to the magnet being detected and other system parameters and can vary considerably.

The controller also performs a second timing function which is triggered by the expanding bellows head as magnet 106 is detected by sensor 107. This second or inlet valve timing function determines the closure of the first inlet valve which supplies the first pump chamber 117. In the case of expansion of the first pumping chamber 117, the controller waits after detection of magnet 106 for a suitable inlet valve closure timing period. After the inlet valve closure timing period the controller then causes the first inlet valve to be closed. Suitable inlet valve closure timing periods are typically in the range of 100 to 300 milliseconds after sensor detection. The specific duration again depends upon the sensor position and other pertinent system parameters.

The third timing period based upon the detection of the magnet in the expanded position is the bellows contraction time delay period. This timing period determines when the bellows contraction chamber is pressurized to thereby contract the bellows and create pressure in the pumping chamber. In the case of transition of the first bellows from expansion to contraction, the bellows contraction time delay period may be in the range of 300–1000 milliseconds. For example if the inlet valve closure timing period is approximately 260 milliseconds then the bellows contraction time delay period may suitably be 520 milliseconds.

The controller also coordinates transfer of pumping from one chamber to the other using additional timing control functions. The forth and fifth timing control functions are triggered by the detection of the contracting pump chamber nearing completion of the discharge stroke. For example, after the first pumping chamber has been charged, expanded, stopped and pressurized in preparation to discharge; the second pumping chamber then completes its discharge stroke. The completion of the discharge stroke is approximately detected by sensing the position of magnet 206 by inward second bellows sensor 208. Detection by sensor 208 is in advance of the fully contracted position. The fourth timing control function determines when the pressure supplied to the contraction chamber, e.g. chamber 283, is released. This contraction chamber pressure release time period is advantageously 0–100 milliseconds after magnet 206 is detected by sensor 208. This will depend upon the position of the contraction sensor and associated magnet, e.g. sensor 208 and magnet 206. The contraction chamber pressure is relieved prior to full contraction of pumping chamber 217 to prevent or reduce the a decrease in flow rates and to reduce or eliminate any hammering which might occur at the end of the contraction stroke. The bellows and head assembly operating in the contractionary mode thus also function by coasting to a stop near the end of the contraction stroke as a result of the inertia of the system.

The fifth timing control period is also triggered by the detection of magnet 206 by the contraction position sensor 208, and is conveniently termed the outlet valve transition timing control period. A delay of 100-300 milliseconds is appropriate between detection by the contraction sensor 208 and the time that the first outlet valve 341 is activated to open and allow fluid to flow from the first pumping chamber. This is done by activating the first outlet valve solenoid 414 and thereby causing the valve to be operated into the open condition. The discharging second outlet valve 342 is also controlled to close at the same time the first outlet valve 341 is opened. This is done by deactivating solenoid valve 420 at the same time as solenoid valve 414 is activated. The specific period of time used for the outlet valve timing delay period will vary due to sensor positioning and other system parameters. The switchover from one outlet valve being open to the other, preferably occurs just before the contents of the pumping chamber is being fully discharged and before pressure drop-off occurs. This allows smooth transition with reduced fluid pulsations and vibration.

The methods further include contracting the charged bellows and associated pumping chamber after the transitions described above have been completed. Continuing the above example, the charged first pumping chamber 117 is then contracted by supplying gas through the activated first bellows contraction solenoid 412 and into the first bellows contraction chamber 183. The pumping or discharging stroke of the first bellows is slower than the expansionary charging stroke which is simultaneously going on in the second pumping chamber 217. The second pumping chamber thus reaches a charged condition and the same sensing and transition steps as described above are performed to terminate expansionary pressure to chamber 284, close second inlet valve 322, and pressurize chamber 283 for contraction of the second bellows and associated pumping chamber 217. The discharging first pump chamber 117 then reaches it nearly contracted state as detected by magnet 106 being sensed by contraction position detector 108. The driving pressure in chamber 183 is discontinued and the outflow is then switched from the first outlet valve to the second outlet valve.

The processes described above are thereafter repeated in alternating fashion to perform the novel pumping methods of this invention. The methods provide nearly continuous fluid delivery at nearly constant pressure with low pulsation and vibration. The reduced vibration reduces associated movement and friction of various component parts of the pump, such as the bellows, bellows sleeve and flow contacting portions of the valves and valve body. The reduced movement and friction accordingly reduce the generation of particles which may contaminant the fluids being pumped. Because of such performance the novel pumps and methods are suitable for low contamination service, such as in the semiconductor processing industry, production of hard drive magnetic memories, compact disk read only memories, flat panel displays and other contamination sensitive processing applications.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A method for pumping using a bellows pump having a pumping chamber which is displaced by a bellows; comprising:

expanding the bellows and pumping chamber by providing a suitable first pressure within an internal bellows tube mounted at least partially within the bellows, to intake fluid into the pumping chamber;

contracting the bellows and pumping chamber by producing a suitable second pressure within the internal bellows tube;

wherein said expanding and contracting steps include sliding the internal bellows tube upon an internal bellows support formed by a piston.

2. A method according to claim 1 wherein said piston divides an interior of the bellows tube into expansion and contraction chambers.

3. A method for pumping using a double bellows pump having a first pumping chamber which is displaced by a first bellows, and a second pumping chamber which is displaced by a second bellows; comprising:

expanding the first bellows and first pumping chamber by providing a suitable pressure within a first internal bellows tube mounted at least partially within the first bellows, to intake fluid into the first pumping chamber;

contracting the second bellows and second pumping chamber by producing a suitable pressure within a second internal bellows tube mounted at least partially within the second bellows, to pump fluid from the second pumping chamber;

contracting the first bellows and first pumping chamber by producing a suitable pressure within the first internal bellows tube, to pump fluid from the first pumping chamber;

expanding the second bellows and second pumping chamber by providing a suitable pressure within the second internal bellows tube, to intake fluid into the second pumping chamber;

wherein said expanding and contracting steps include sliding the first and second internal bellows tubes upon internal bellows supports formed by pistons.

4. A method according to claim 3 wherein said expanding and contracting steps include sliding the first and second internal bellows tubes upon internal bellows supports formed by first and second pistons which divide interiors of the first and second bellows tubes into expansion and contraction chambers.

5. A method for pumping using a double bellows pump having a first pumping chamber which is displaced by a first bellows, and a second pumping chamber which is displaced by a second bellows; comprising:

controllably opening a first inlet valve to allow fluid to flow from an intake chamber to the first pumping chamber;

controllably closing a second inlet valve to prevent fluid flow between the second pumping chamber and the intake chamber;

controllably closing a first outlet valve to prevent fluid flow between the first pumping chamber and an outflow chamber;

controllably opening a second outlet valve to allow fluid flow from the second pumping chamber to the outflow chamber;

expanding the first bellows and first pumping chamber by providing a suitable pressure within a first bellows operator to intake fluid into the first pumping chamber;

contracting the second bellows and second pumping chamber by providing a suitable pressure within a second bellows operator to pump fluid from the second pumping chamber;

controllably closing the first inlet valve;

controllably opening the second inlet valve;

controllably opening the first outlet valve;

controllably closing the second outlet valve;

contracting the first bellows and first pumping chamber by providing a suitable pressure within the first bellows operator, to pump fluid from the first pumping chamber;

expanding the second bellows and second pumping chamber by providing a suitable pressure within the second bellows operator, to intake fluid into the second pumping chamber;

wherein said expanding and contracting steps include sliding the first and second internal bellows tubes upon a bellows support formed by at least one piston.

6. A method according to claim 5 wherein said expanding and contracting steps include sliding the first and second internal bellows tubes upon internal bellows supports formed by first and second pistons which divide interiors of the first and second bellows tubes into expansion and contraction chambers.

7. A method according to claim 5 wherein said controllably opening and controllably closing steps are accomplished by operating pneumatic valve operators.

8. A method according to claim 5 wherein said controllably opening and controllably closing steps are accomplished by controlling electrically controllable valves which controllably supply fluid of suitable pressure to valve operators.

9. A bellows pump, comprising:

frame;

a bellows mounted for movement to expand and contract a pumping chamber;

a bellows operator for controlling movement of the bellows;

an inlet valve for controlling fluid flow from a pump intake to the pumping chamber;

an outlet valve for controlling fluid flow from the pumping chamber to a pump outflow;

a bellows tube connected to movable portions of the bellows; said bellows tube extending within a portion of said bellows; said bellows tube being mounted for movement relative to said frame;

wherein said bellows tube is mounted for translational movement relative to a stationary bellows tube support.

10. A pump according to claim 9 wherein said bellows tube is mounted for guided translational movement relative to the stationary bellows tube support.

11. A pump according to claim 9, said stationary bellows tube support being a stationary piston mounted within said at least one bellows tube.

12. A pump according to claim 9, said stationary bellows tube support including:

a stationary piston mounted within said at least one bellows tube;

a bellows tube head piece mounted for slidable movement upon a piston rod which supports said stationary piston.

13. A pump according to claim 9 and further comprising:

a bellows tube sleeve mounted upon said bellows tube adjacent the pumping chamber.

14. A bellows pump, comprising:

a frame;

a bellows mounted for movement to expand and contract a pumping chamber;

a bellows operator for controlling movement of the bellows;

an inlet valve for controlling fluid flow from a pump intake to the pumping chamber;

an outlet valve for controlling fluid flow from the pumping chamber to a pump outflow;

a bellows tube which is connected to a movable portion of said bellows; said bellows tube extending within a portion of said bellows; said bellows tube being mounted for movement relative to said frame;

a piston rod connected to the frame and extending longitudinal relative to the bellows;

a stationary piston mounted upon the piston rod and within said bellows tube to allow longitudinal movement of the bellows tube thereon;

a bellows tube head piece mounted for slidable movement upon a piston rod which supports said stationary piston.

15. A pump according to claim 14 and further comprising:

a first bellows operating chamber existing between the piston and the bellows tube;

a second bellows operating chamber existing between the piston and the bellow tube head;

wherein the bellows operator is formed by controlling fluid pressures within the first and second bellows operating chambers.

16. A pump according to claim 14 and further comprising:

a first bellows operating chamber existing between the piston and the bellows tube;

a second bellows operating chamber existing between the piston and the bellow tube head;

at least one bellows operating fluid supply conduit formed through said piston rod;

wherein the bellows operator is formed by controlling fluid pressures within the first and second bellows operating chambers.

17. A double bellows pump, comprising:

a first bellows mounted for movement to expand and contract a first pumping chamber;

a second bellows mounted for movement to expand and contract a second pumping chamber;

a first bellows operator for controlling movement of the first bellows;

a second bellows operator for controlling movement of the second bellows;

a valve body;

a first inlet valve for controlling fluid flow from the pump intake to the first pumping chamber;

a second inlet valve for controlling fluid flow from a pump intake to the second pumping chamber;

a first outlet valve for controlling fluid flow from the first pumping chamber to the pump outflow;

a second outlet valve for controlling fluid flow from the second pumping chamber to a pump outflow;

wherein the first and second bellows operators are pneumatic operators; and first and second bellows tubes which are connected to movable portions of the first and second bellows; said bellows tubes extending within portions of said first and second bellows; said bellows tubes being mounted for movement upon stationary bellows tube supports.

18. A pump according to claim 17 wherein the stationary bellows tube supports include stationary pistons mounted within the bellows tubes.

19. A pump according to claim 17 wherein the stationary bellows tube supports include:

a stationary piston mounted within the bellows tube;

a bellows tube head mounted for slidable movement upon a piston rod which supports said stationary piston.

20. A double bellows pump, comprising:

a first bellows mounted for movement to expand and contract a first pumping chamber;

a second bellows mounted for movement to expand and contract a second pumping chamber;

a first bellows operator for controlling movement of the first bellows;

a second bellows operator for controlling movement of the second bellows;

a valve body;

a first inlet valve for controlling fluid flow from the pump intake to the first pumping chamber;

a second inlet valve for controlling fluid flow from a pump intake to the second pumping chamber;

a first outlet valve for controlling fluid flow from the first pumping chamber to the pump outflow;

a second outlet valve for controlling fluid flow from the second pumping chamber to a pump outflow; and at least one bellows tube which is connected to a movable portion of at least one of said bellows; said bellows tube extending within a portion of said at least one of said bellows; said at least one bellows tube being mounted for movement upon a stationary bellows tube support.

21. A pump according to claim 20 and further comprising a controller which controls the first and second bellows operators to achieve an approximately constant outflow from the pump.

22. A pump according to claim 20 and further comprising a controller which controls the first and second bellows operators in a substantially out of phase relationship.

23. A pump according to claim 20 said at least one bellows tube being mounted for guided translational movement.

24. A pump according to claim 20 wherein said stationary bellows tube support is a stationary piston mounted within said at least one bellows tube.

25. A pump according to claim 20 wherein said stationary bellows tube support includes:

a stationary piston mounted within said at least one bellows tube;

a bellows tube head mounted for slidable movement upon a piston rod which supports said stationary piston.

26. A pump according to claim 20 and further comprising:

at least one bellows tube sleeve mounted upon said at least one bellows tube and adjacent a pumping chamber.

27. A pump according to claim 20 wherein the first and second bellows operators are pneumatic operators.

28. A pump according to claim 5 and further comprising first and second bellows tubes which are connected to movable portions of the first and second bellows; said bellows tubes extending within portions of said first and second bellows.

29. A pump according to claim 5 and further comprising first and second bellows tubes which are connected to movable portions of the first and second bellows; said bellows tubes extending within portions of said first and second bellows; said bellows tubes being mounted for translational movement.

30. A pump according to claim 27 and further comprising:

first and second bellows tubes which are connected to movable portions of the first and second bellows; said bellows tubes extending within portions of said first and second bellows;

first and second bellows tube sleeves mounted upon said first and second bellows tubes adjacent the first and second pumping chambers.

31. A pump according to claim 20 wherein:

the first and second bellows operators are pneumatic operators;

the first and second inlet valves are operated by pneumatic operators;

the first and second outlet valves are operated by pneumatic operators.

32. A pump according to claim 20 wherein:

the first and second bellows operators are pneumatic operators;

the first and second inlet valves are operated by pneumatic operators; said first and second inlet valves functioning to act as relief valves for over-pressure conditions in the first and second pumping chambers respectively;

the first and second outlet valves are operated by pneumatic operators.

* * * * *